United States Patent [19]

Hession et al.

[11] 4,294,383

[45] Oct. 13, 1981

[54] MORTAR APPLYING DEVICE

[75] Inventors: Rodney J. Hession; Brent M. Hession, both of New Orleans, La.

[73] Assignee: Hession Industries, Inc., New Orleans, La.

[21] Appl. No.: 113,325

[22] Filed: Jan. 18, 1980

[51] Int. Cl.[3] ..... B05D 1/26; B05D 1/30; F04G 21/16

[52] U.S. Cl. ..... 222/611; 401/4

[58] Field of Search ..... 222/611, 612, 625; 401/4, 48, 193

[56] References Cited

U.S. PATENT DOCUMENTS

| | | | |
|---|---|---|---|
| 1,833,582 | 11/1931 | Kavanagh | 222/611 X |
| 2,683,981 | 7/1954 | Richey | 401/4 |
| 3,148,432 | 9/1964 | Garnett, Jr. | 222/611 X |
| 3,791,559 | 2/1974 | Foye | 222/611 |
| 3,887,114 | 6/1975 | Villanovich | 401/4 X |
| 4,135,651 | 1/1979 | Hession et al. | 222/611 |

FOREIGN PATENT DOCUMENTS

| | | | |
|---|---|---|---|
| 1096113 | 6/1955 | France | 401/193 |

*Primary Examiner*—David A. Scherbel

*Attorney, Agent, or Firm*—Kemon & Estabrook

[57] ABSTRACT

A mortar depositing or applying device including a hopper with a partition or divider therein defining a pair of outlets for delivering mortar to a row of blocks or bricks being laid as a wall or the like. The hopper is provided with a trailing former or guide member adjacent each outlet which is drawn over the mortar to form or shape same as the hopper is moved along the row of blocks. The hopper is provided with rollers or wheels on one side that engage a mortar guide board to insure the proper forming of the ribbons or beads of mortar adjacent the outer edges of the bricks or blocks. An undercarriage which receives and supports the hopper is provided with a plurality of wheels or rollers which are drawn over the uppermost surface of a row or course of bricks or blocks to facilitate the depositing of the mortar from the hopper.

5 Claims, 7 Drawing Figures

MORTAR APPLYING DEVICE

BACKGROUND OF THE INVENTION

The present invention relates to static structures, such as masonry walls and buildings and particularly to processes for assembling exposed modules, that is, brick or block laying and the apparatus associated therewith.

In the building of a wall or the like, the laying or running of a course of bricks or blocks is usually carried out by manually applying mortar to said bricks or blocks or through the use of a mortar applying machine for depositing mortar on said bricks or blocks. The use of mortar applying machines or the like is typified by Applicant's prior U.S. Pat. No. 4,135,651 dated Jan. 23, 1979, as well as Patent to Wise U.S. Pat. No. 3,162,886 dated Dec. 29, 1964, and the patent to Price 4,043,487 dated Aug. 23, 1977. These machines utilize one or more hoppers that have associated therewith a plurality of nozzles for directing the mortar onto the upper surface of the row of blocks in the form of spaced ribbons that are disposed adjacent the outer edges of the blocks.

While the foregoing concept has constituted an advancement over the manual application of mortar, such machines have not been entirely satisfactory. It has been determined that the nozzles have had a tendency to clog up to a degree wherein one of the beads or ribbons of mortar being laid upon the upper surface of the row of bricks or blocks would be of a size smaller than the other bead or ribbon of mortar. In addition, the mode of moving the mortar applying device over the row or course of bricks or blocks has not been smooth and steady resulting in uneven applications of mortar to the course of blocks or bricks.

SUMMARY OF THE INVENTION

The present invention is directed to a mortar depositing device that is configured to apply beads of mortar of uniform size and shape adjacent the outer edges of a row or course of bricks or cement blocks. The mortar device includes a hopper having a divider to facilitate the delivery of mortar to openings in the hopper bottom for same upon the upper surface of a row or course of bricks or blocks adjacent the outer edge of the bricks or blocks. The hopper is supported upon an undercarriage having a plurality of wheels or rollers that moves over or along the central portion of the row or course of bricks or blocks with the side portions of the hopper terminating adjacent the outer edges of the course of bricks or blocks.

The hopper is provided on one side with spaced rollers or wheels that engage a mortar or guide board for maintaining the hopper in aligned relation with the row or course of bricks or blocks over which it is being moved. The undercarriage is provided with detachable guide wheels at each end that engage the side faces of the bricks or blocks in the previously laid row or course of bricks or blocks for maintaining the hopper in aligned relation with the row or course of bricks or blocks previously laid.

DESCRIPTION OF THE PREFERRED EMBODIMENT

Figure 1:
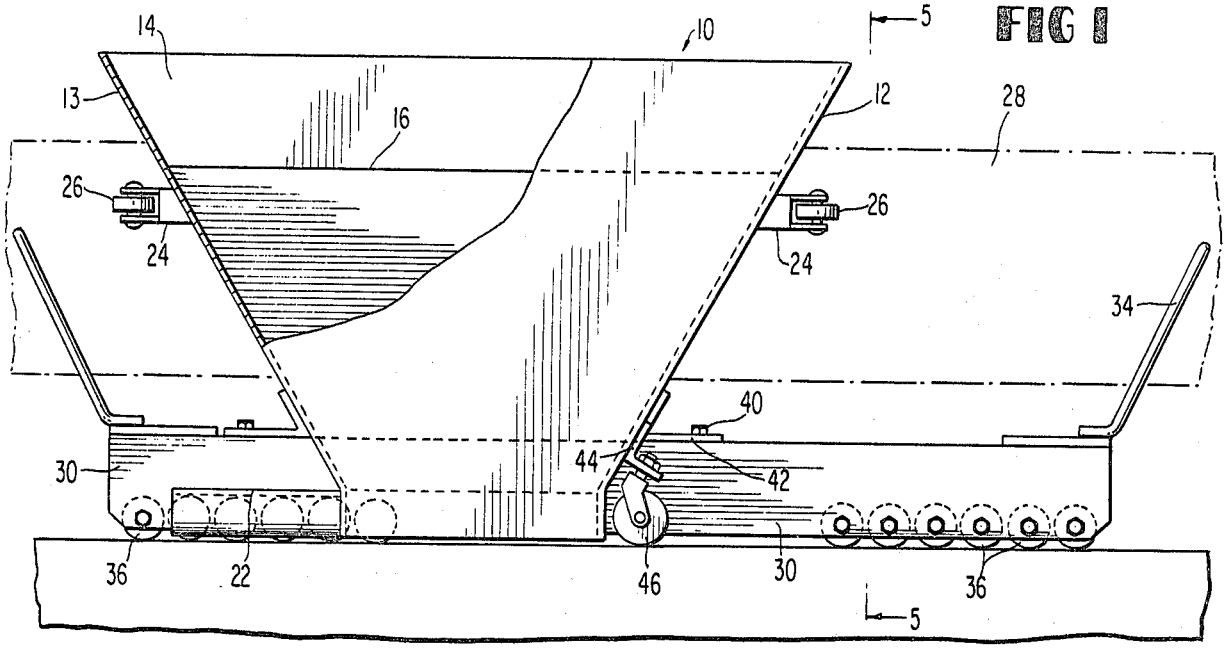
FIG. 1 is a side elevational view of a mortar applying device embodying the present invention.
Figure 2:
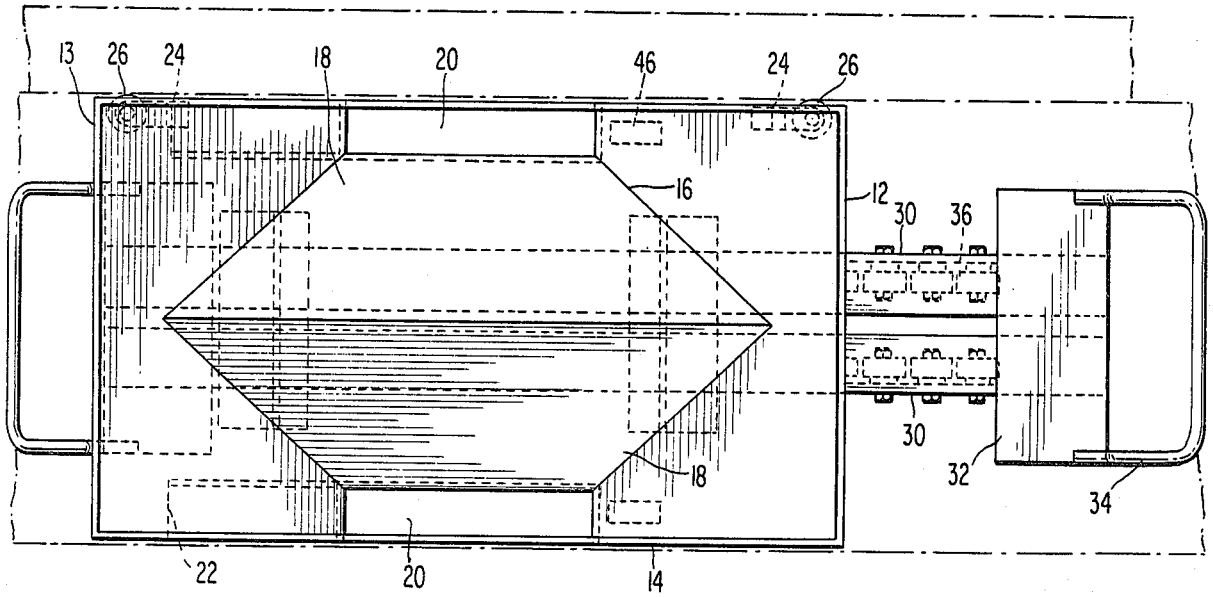
FIG. 2 is a top plan view of the mortar applying device of FIG. 1.

Referring to the drawings there is shown in FIGS. 1 and 2, a rectangular shaped hopper 10 consisting of flat end plates 12 and 13 secured to flat tapered side members 14 by any suitable means, such as welding. The side members and end plates when assembled define a hopper having a rectangularly shaped open upper end with said hopper tapering to a relatively small open bottom or lower end. The hopper 10 is provided with a cone shaped divider 16 consisting of a pair of inclined plate members 18 secured to one another along a common edge with the ends of the plate members being secured to the inner faces of the flat end plates 12 and 13. The cone plate members 18 are arranged within the hopper 10 with the lower ends of said plate members terminating in spaced parallel relation to the lower ends of the side members 14 so as to define with said side members 14 suitable discharge openings or outlets 20.

As shown in FIG. 1, the end plate member 12 extends from the top to the bottom of the side members 14 while the end plate member 13 has its lower outer edge portions terminating at a slight distance above the lower ends of the side members 14. The lower end portion of the end plate member 13 is provided with a pair of mortar guide members 22, or formers which are of semi-cylindrical configuration, and which are secured to the bottom edge portion of the end plate member 13 and also to the lower end portion of the side member 14. The end plates 12 and 13 also have secured thereto, adjacent one of the side members 14, suitable brackets 24 which have rollers 26 mounted therein that are adapted to engage a guide board 28 to facilitate the proper positioning of the hopper 10 upon a row or course of bricks or blocks during the laying of beads or ribbons of mortar upon said row of bricks or blocks.

Figure 3:
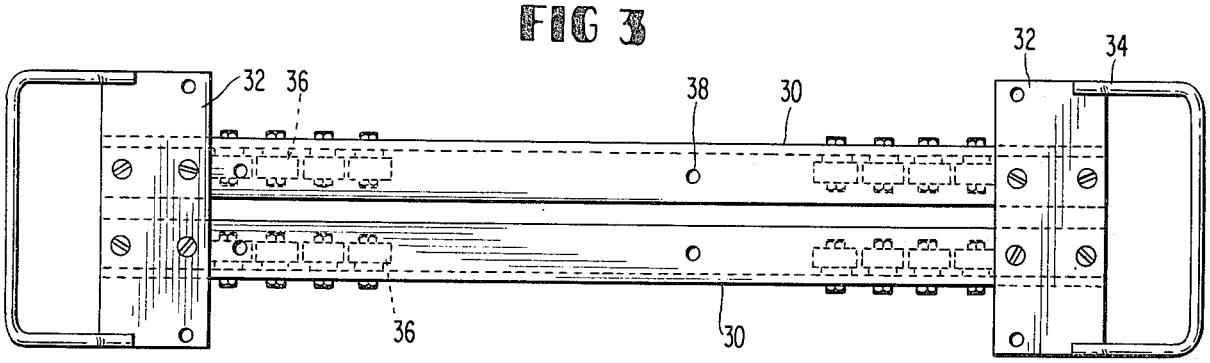
FIG. 3 is a top plan view of the undercarriage for the mortar applying device of FIG. 1.
Figure 4:
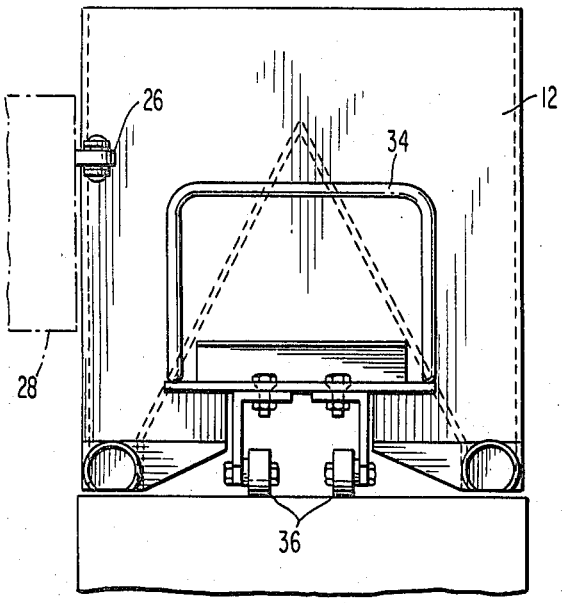
FIG. 4 is an end elevational view of the mortar applying device of FIG. 1.
Figure 5:
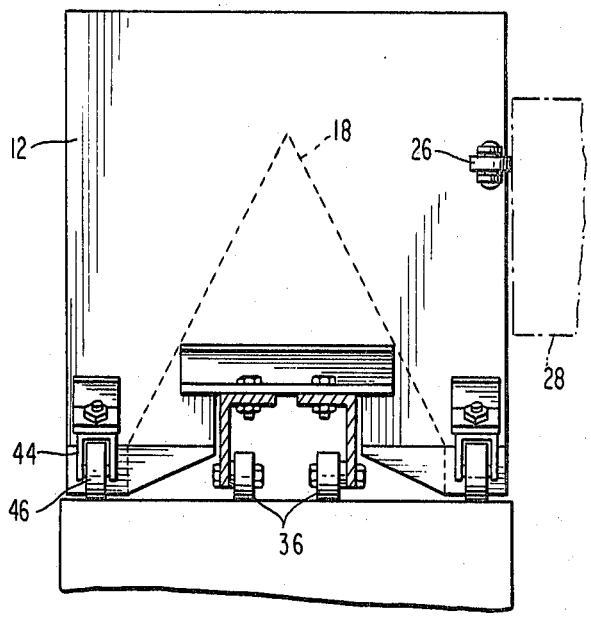
FIG. 5 is a vertical sectional view of the mortar applying device, the view being taken on the plane 5—5 of FIG. 1.

The end plates 12 and 13 are each provided with suitable openings adjacent their lower edge portions within the area defined by the inclined plate members 18 of the cone shaped divider 16. The openings in the end plates 12 and 13 are in alignment with one another and thus constitute a saddle structure that is mounted upon spaced beam members 30 of an undercarriage chassis structure, FIG. 3. The ends of the beam members 30 are secured to end plates 32, which in turn have upwardly projecting handles 34 to facilitate the manual movement of the undercarriage structure and hopper 10 over the surface of a course or row of bricks or blocks. The beam members 30 are preferably of channel configuration and have a plurality of rollers 36 mounted in the channel area adjacent their respective ends. The beam members 30 are provided with suitable apertures 38 that are adapted to receive bolts 40 mounted in brackets 42 that are secured to the end plate members 12 and 13.

As shown in FIGS. 1 and 2, the hopper 10 is mounted upon the beam members 30 in an area offset from the center of said beam members so that the weight of the hopper and its contents will tend to be distributed more over the rollers carried by the beam members adjacent the trailing end of the undercarriage chassis structure. The hopper 10, in being so positioned on the undercarriage chassis structure as to substantially overlie the rollers at the trailing end of said chassis structure, will locate the mortar guide or former members 22 on opposite sides of the chassis structure. The former or guide members will be substantially at the rear or trailing end of said chassis structure and thus will form the mass of mortar flowing from the hopper outlets 20 into beads or ribbons upon the course or row of bricks or blocks over which the hopper is being moved. The end plate 12 is provided adjacent its lower end portion with a pair of angle plate members 44, FIGS. 1 and 6, that have mounted thereon wheels 46 which act as leveling members for the hopper 10 as it is being moved over a course or row of bricks or blocks during the application of mortar thereto.

In the use of the mortar applying device of the present invention, the undercarriage chassis with the hopper 10 mounted thereon and filled with mortar is manually drawn over the footing or foundation or a previously laid row or course of bricks or cement blocks for the purpose of depositing mortar thereupon. Prior to moving the hopper 10 over the row or course of bricks or blocks, the guide board 28 is positioned in a proper manner so that as the hopper 10 is moved, the rollers 26, mounted on the hopper, will engage said guide board to properly position the hopper upon the row or course of bricks or blocks upon which the mortar is to be deposited. The hopper 10 is moved by manually grasping the handle 34 and pulling the undercarriage chassis with the hopper thereon over the upper surface of the course or row of bricks or blocks which movement will cause the mortar contained within the hopper to flow through the outlet openings 20 onto the upper surface of the bricks or blocks adjacent the outer edges of said bricks or blocks.

As the hopper and undercarriage chassis are drawn over the upper surface or face of the bricks or blocks the lower portions of the side members 14 and the cone plate members will control the flow of mortar onto the bricks or blocks. The outlets 20 being free of any closure members, the mortar will flow freely through said outlets into the bricks or blocks during the movement of the hopper. The guide or former members 22 will shape the mortar into beads or ribbons and aid in controlling the flow of the mortar from the hopper so that the beads of mortar will be uniform throughout their length and be deposited adjacent the edges of the bricks or blocks. The mortar will thus have a free flowing path from the hopper to the upper surface of the bricks or blocks and the passage of the guide members 22 over the mortar will control the size of the beads of mortar and insure that said beads are uniform in all respects from one end of the row or course of bricks to the other. Thus the operator in moving the hopper over the course or row of bricks or blocks will be primarily concerned with maintaining the rollers 26 in engagement with the guide board 28 so as to properly position the beads of mortar adjacent the outer edges of the bricks or blocks and the operator will not have to concern himself at all with the type of beat that is being deposited upon the surface of said bricks or blocks.

The undercarriage chassis will move over the center of the course of bricks or blocks during the application of the beads of mortar thereto and the rollers 36 of said undercarriage chassis will engage the upper surface of the bricks or blocks so as to maintain the hopper in a level position in conjunction with the wheels 46 as they move along the outer edge portions of the bricks or blocks. Thus, if the blocks upon which the beads or ribbons of mortar are being applied happen to be cinder blocks, the rollers 36 of the undercarriage chassis structure will engage a sufficient number of the webs in said cinder blocks to provide a sturdy support for the hopper while at the same time enabling said hopper and undercarriage chassis structure to be readily drawn over the upper surface of said blocks. This is due to the concept of having the hopper positioned substantially over the rollers of the trailing end of the undercarriage chassis structure and also due to the length of the undercarriage with respect to the hopper. The roller arrangement at the respective ends of the chassis structure will insure that certain of said rollers will be in engagement with one or more of the webs of a plurality of cinder block which arrangement will readily enable the hopper to be moved in a continuous manner over a course of cinder blocks while at the same time depositing beads of mortar adjacent the respected edges of said blocks.

Figure 6:
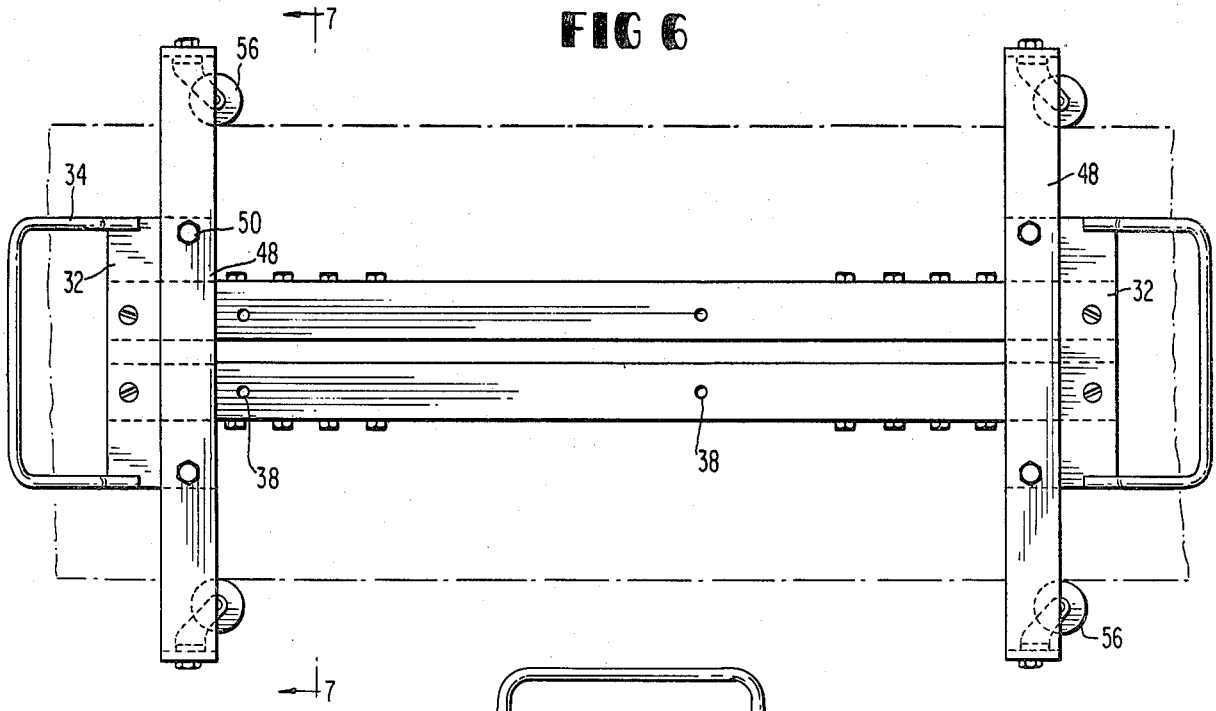
FIG. 6 is a top plan view of the undercarriage with the side guide wheels mounted thereon.
Figure 7:
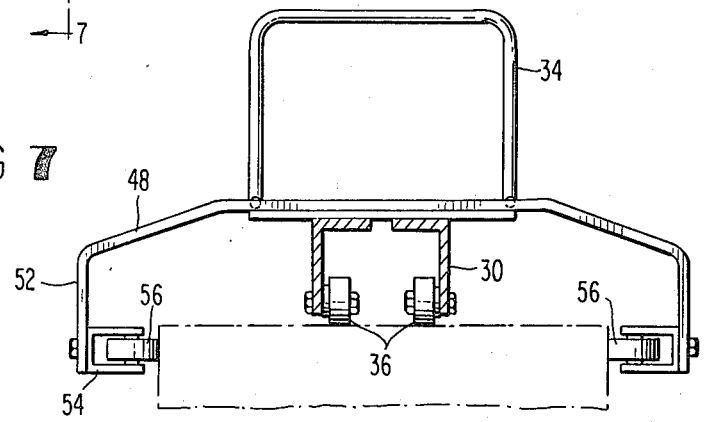
FIG. 7 is a vertical sectional view of the undercarriage shown in FIG. 6, the view being taken on the line 7—7 of FIG. 6.

In the event that a wall or a similar type of structure is to be built and it is not feasible to use a guide board such as board 28, then the undercarriage chassis structure can have secured to its respective ends suitable guide members. As shown in FIGS. 6 and 7, the end plates 32 have transverse bar members 48 secured thereto by suitable bolts 50. The bar members 48 terminate in downwardly depending segments 52, FIG. 7, that have secured to the inner faces thereof adjacent the ends thereof suitable brackets 54. The brackets 54 are provided with rollers 56 which are adapted to engage the inner and outer faces of the bricks or blocks constituting a previously laid row of bricks or blocks, FIG. 6.

Thus the hopper 10 mounted upon the undercarriage chassis structure with the bar members 48 secured thereto can be readily moved over and along a course of previously laid bricks or blocks in the same manner as described here and above with respect to FIGS. 1 and 2. During this movement of the hopper and undercarriage chassis structure, the rollers 56 will engage the outer faces of a previously laid row of bricks or blocks so as to maintain the chassis and hopper in proper position for laying a ribbon or bead of mortar adjacent each edge of the row or course of bricks or blocks over which the chassis and hopper are being moved.

Although the foregoing description is necessarily of a detailed character in order that the invention may be completely set forth it is to be understood that the specific terminology is not intended to be restrictive or confining, and that various rearrangements of parts and modifications of detail may be resorted to without departing from the scope or spirit of the invention as herein claimed.

I claim:

1. A device for applying mortar to a course of masonry units having side faces and a top surface, comprising a hopper formed with side members and end plate members and having an open top and bottom, plate members defining a divider mounted within said hopper and defining a pair of mortar receiving and delivering compartments communicating with the open top and bottom, the portion of said end plate members of said hopper lying between said plate members of said divider are formed to define an elongated recess extending through the bottom of said hopper, a wheeled undercarriage chassis entending through said recess and fastening means on said hopper for securing same to said chassis for moving said hopper over the top surface of a course of masonry units and semi-cylindrical guide members secured to said hopper in trailing relation for depositing uniform beads of mortar upon said surface, contemporaneous with the moving of said hopper.

2. A device for applying mortar as set forth in claim 1 wherein said undercarriage chassis includes a pair of elongated channel shaped members arranged in spaced parallel relation to one another, the ends of said channel shaped members being secured to end members.

3. A device for applying mortar as set forth in claim 2 wherein the end portions of said channel shaped members have rollers mounted therein with handles secured to said end members for moving the undercarriage chassis and hopper over the top surface of the masonry units.

4. A device for applying mortar as set forth in claim 2 wherein said end members have an elongated bar with depending end portions secured thereto in a plane transverse to the longitudinal axis of said channel shaped members, inwardly projecting rollers carried by said depending end portions for engaging the side faces of said masonry units as said hopper is moved over said top surface.

5. A device for applying mortar as set forth in claim 1 wherein said hopper is mounted on said undercarriage chassis adjacent one end thereof and overlies a portion of the rollers mounted in said end of said channel shaped members.

* * * * *